US005924249A

United States Patent [19]

Kroll et al.

[11] Patent Number: 5,924,249

[45] **Date of Patent: *Jul. 20, 1999**

[54] STAIRWAY STEP ASSEMBLY

[75] Inventors: William P Kroll, Medina; Paul C Probst, Plymouth; Karl J F Kroll, Maple Grove, all of Minn.

[73] Assignee: Protector Car, Inc., Plymouth, Minn.

[ * ] Notice: This patent is subject to a terminal disclaimer.

[21] Appl. No.: 08/925,872

[22] Filed: Sep. 9, 1997

Related U.S. Application Data

[62] Division of application No. 08/580,167, Dec. 28, 1995, Pat. No. 5,664,379.

[51] Int. Cl.[6] ..... E04F 11/02

[52] U.S. Cl. ..... 52/184; 52/183; 52/188; D25/69

[58] Field of Search ..... 52/177, 179, 182, 52/183, 184, 188, 191; D25/69; 182/120, 121, 122

[56] References Cited

U.S. PATENT DOCUMENTS

| | | | |
|---|---|---|---|
| D. 287,283 | 12/1986 | Johnson | D25/69 |
| 514,342 | 2/1894 | Whaley | 52/191 |
| 2,415,327 | 2/1947 | Yothers | 182/120 |
| 3,343,316 | 9/1967 | McIntire | 52/190 |
| 3,978,628 | 9/1976 | Turner | 52/188 |
| 4,406,347 | 9/1983 | Stathopoulos | 52/183 |
| 4,457,398 | 7/1984 | Loix | 52/182 |
| 5,357,724 | 10/1994 | Sonoda | 52/182 |
| 5,465,809 | 11/1995 | Panicci | 182/121 |

FOREIGN PATENT DOCUMENTS

| | | | |
|---|---|---|---|
| 1468340 | 2/1967 | France | 52/183 |
| 3005482 | 8/1981 | Germany | 52/182 |
| 600092 | 6/1978 | Switzerland | 52/183 |

*Primary Examiner*—Michael Safavi
*Attorney, Agent, or Firm*—Skinner and Associates

[57] ABSTRACT

A stairway step assembly for use as an aid in climbing a stairway. The assembly is particularly useful to elderly and handicapped users who have difficulty climbing a standard stairway due to the height or rise of the steps thereof. The assembly provides a means of quickly, economically, and safely altering the step arrangement of the standard stairway with minimal or no modification to the permanent structure of the stairway. The assembly comprises a plurality of step members having predetermined horizontal dimensions and a predetermined height which is approximately one-half the height or rise distance of a standard step. The assembly further comprises an attachments mechanism for connecting the step members in place on the top or horizontal section of standard steps.

4 Claims, 12 Drawing Sheets

STAIRWAY STEP ASSEMBLY

CROSS-REFERENCE TO RELATED APPLICATIONS

This is a division of U.S. patent application No. 08/580,167, filed Dec. 28, 1995, now U.S. Pat. No. 5,664,379.

STATEMENT REGARDING FEDERALLY SPONSORED RESEARCH AND DEVELOPMENT

Not applicable.

BACKGROUND OF THE INVENTION

1. Field of the Invention.

The present invention relates, generally to stairway structures. More particularly, the invention relates to a stairway step assembly for use as an aid in climbing a stairway. The invention is particularly useful to elderly and handicapped users who have difficulty climbing a standard stairway due to the height or rise of the steps thereof. The invention provides a means of quickly, economically, and safely altering the step arrangement of the standard stairway with minimal or no modification to the permanent structure of the stairway.

2. Background Information.

In the past, various devices have been used and/or proposed to aid the elderly, handicapped and special needs individuals in climbing stairways or stairs. However, these devices have significant limitations and shortcomings. Specifically, prior art devices are believed to be difficult and expensive to construct and deploy, lack adjustability, and require substantial modification to the existing stairway structure.

Despite the need in the art for a stairway climbing aid device or assembly which overcomes the disadvantages, shortcomings and limitations of the prior art, none insofar as is known has been developed or proposed.

Accordingly, it is an object of the present invention to provide a stairway step assembly which serves as an aid in climbing the stairway. It is a further object of this invention to provide an assembly which is easy and inexpensive to construct and deploy, fully adjustable, and requires little or no modification to the existing stairway structure, and which overcomes the limitations and shortcomings of the prior art.

BRIEF SUMMARY OF THE INVENTION

The apparatus of the present invention provides an improved stairway step assembly for use in aiding climbing of the stairway by the user.

The basic assembly comprises a plurality of step members, the step members having predetermined horizontal dimensions and a predetermined height which is approximately one-half the height of a step of a standard stairs. The assembly further comprises means for connecting each the step member in a fixed position on a top, horizontal section of the standard stairs step.

The features, benefits and objects of this invention will become clear to those skilled in the art by reference to the following description, claims and drawings.

DETAILED DESCRIPTION

Figure 2:
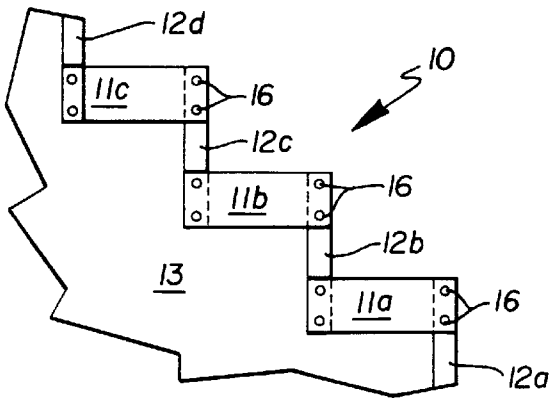
FIG. 2 is a left side view of the assembly.
Figure 4:
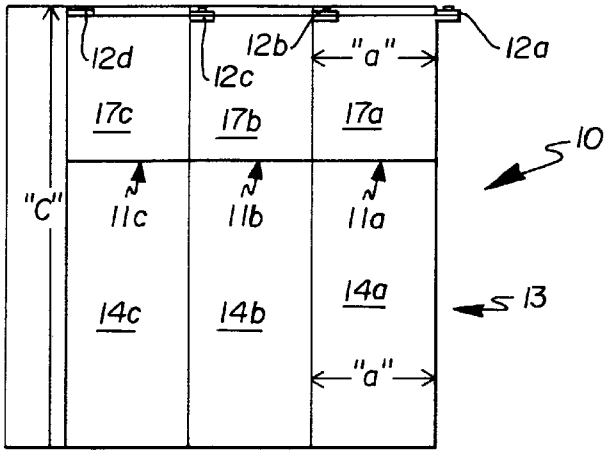
FIG. 4 is a top view of the assembly.
Figure 1:
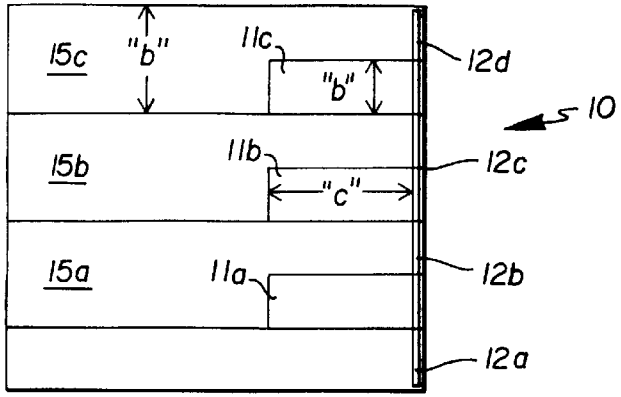
FIG. 1 is a front view of a portion of a first embodiment of the stairway step assembly of the present invention operatively deployed on a section of a stairway.
Figure 3:
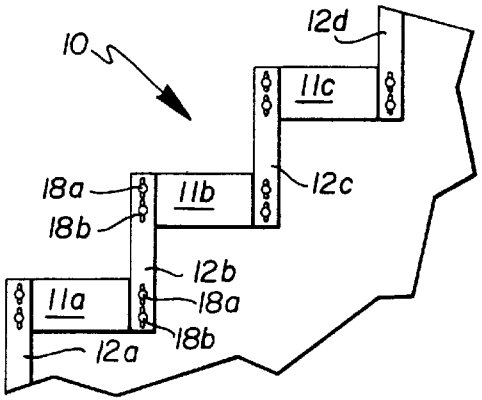
FIG. 3 is a right side view of the assembly.

Referring to the drawings, wherein like reference numerals designate like or similar elements throughout, several embodiments of the stairway step assembly of the present invention are illustrated.

Referring to FIGS. 1–4, one embodiment of the stairway step assembly 10 of the present invention comprises a plurality of step members 11 *a–c* and a plurality of connection members 12 *a–d*. A portion of the assembly 10 is shown operatively deployed on a standard stairs 13 which have a series of horizontal steps 14 of a predetermined depth "a" of approximately 8–12 inches (20.5–30 cm.) and interspaced vertical risers 15 of a predetermined height "b" of approximately 6–8 inches (15.25–20.5 cm.). The lateral width "c" of the steps 14 and risers 15 are equivalent. Only a portion of the assembly 10 is shown for purposes of describing the features of the invention, and the number of step members 11 and connectors 12 may be varied depending upon the size of the stairs 13 on which the assembly 10 is deployed.

The step members 11 of the assembly 10 have a box shaped configuration with a predetermined depth "a'", height "b'" and width "c'". Step member 11 depth "a'" is preferably equivalent to the depth "a" of a stairs step 14. Step member 11 height "b'" is preferably approximately one-half the height "b" of a stairs riser 15. And, step member 11 width "c'" is approximately one-third the width "c" of the stairs step 14. In use, the step members 11 are placed on the top surface of successive steps 14 of the stairs 13 at a far side thereof so as to be closely spaced from a wall or other surface (not shown) adjoining the stairs 13. The right side of each step member 11 has a pair of apertures 16 which are vertically aligned with respect to each other for attachment of the connection member 12. Apertures 16 may alternatively or additionally be placed on the left side of the step members 11 for deployment of the step members 11 on the left side of the stairs 13. The step members 11 have a top surface 17 upon which the user places their feet while climbing the stairs 13. The top surface 17 is preferably fitted with a non-slip member such as (not shown). The step members 11 provide an intermediary step between the stair steps 14. They decrease the height or reach a user must raise or lower their feet while ascending or descending the stairs 13. The step members 11 may optionally be fitted with a heating pad or strip (not shown) to melt ice when deployed on an exterior stairs, and/or lighting means such as a reflector or an electrolumnescent strip for improved visibility during nighttime or low light use.

The connection members or connectors 12 are rectangular, flat plate structures. They have a preferred length which is equivalent to the combined heights of a single step riser 15 and a single step member 11. The connectors 12 have a set of two apertures or slots 18*a–b* disposed near each of its ends. The apertures 18*a–b* are vertically aligned with respect to each other when viewed in an operative orientation, and are preferably elongated in such vertical dimension. In use, the connectors 12 link adjacent step members 11 by bolts or equivalent fastening means 19 disposed through connector apertures 18*a–b* and into step apertures 16. The elongated nature of apertures 18*a–b* permits a predetermined degree of vertical adjustment (commonly referred to as "rise") of the step members 11 with respect to the connectors 12. The connectors 12 maintain the step members 11 in place on the stairs 13, without the need to physically connect the step members 11 to the side wall and without the need to permanently connect the members 11 to the stairs itself.

Figure 5:
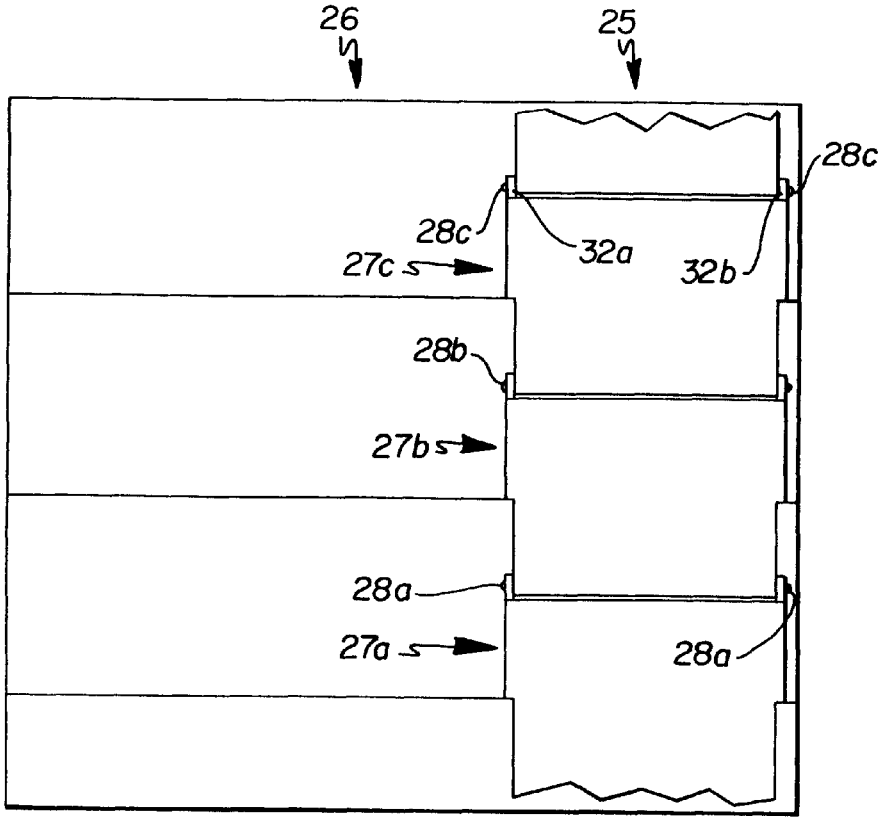
FIG. 5 is a front view of a portion of a second embodiment of the assembly.
Figure 6:
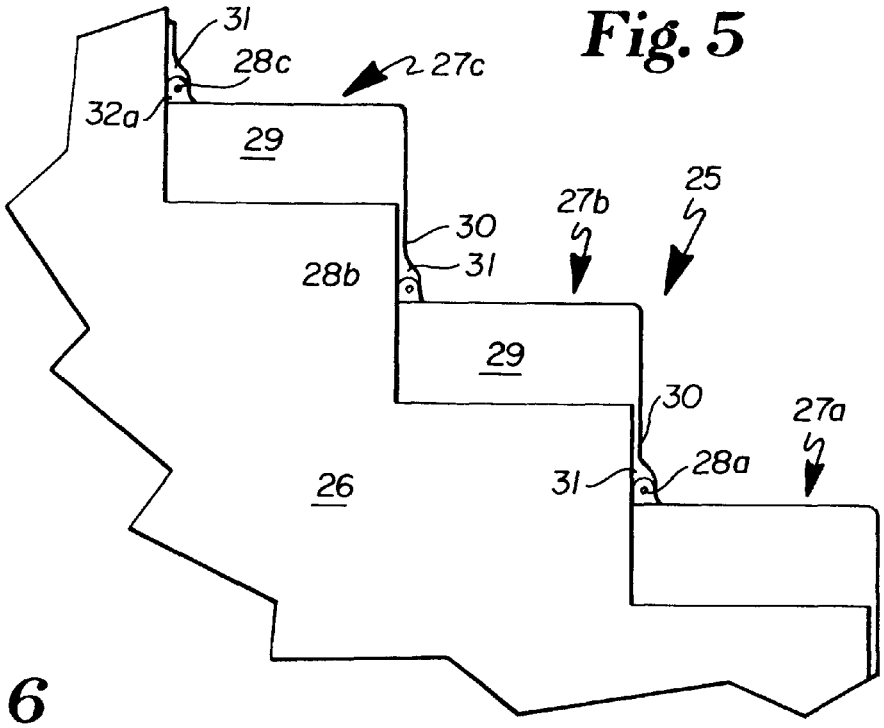
FIG. 6 is a left side view of the assembly shown in FIG. 5.

Referring to FIGS. 5 and 6, a second embodiment of the stairway step assembly 25 is shown deployed on stairs 26 of equivalent dimensions to that of stairs 13 discussed above. The assembly 25 comprises a plurality of step members 27*a–c* and a plurality of connection members 28. The step member 27 have a box shaped upper portion 29 and a unitary flat, front facing lower portion 30 which extends downwardly from the upper portion 29 for connection to the lower successive step member 27. The bottom edge 31 of the lower portion 30 is thickened and has a laterally disposed, cylindrical channel therein. The upper portion 29 of each step further has a pair of connection extensions 32*a–b* connected to its top surface at the rearward corners thereof. The extensions 32*a–b* permit coupling with the next higher step member 27. The connection member 28 is an elongated bolt that extends through one extension 32*a*, the channel in portion 31 and through the other extension 32*b* to connect adjacent step members 27.

Figure 7:
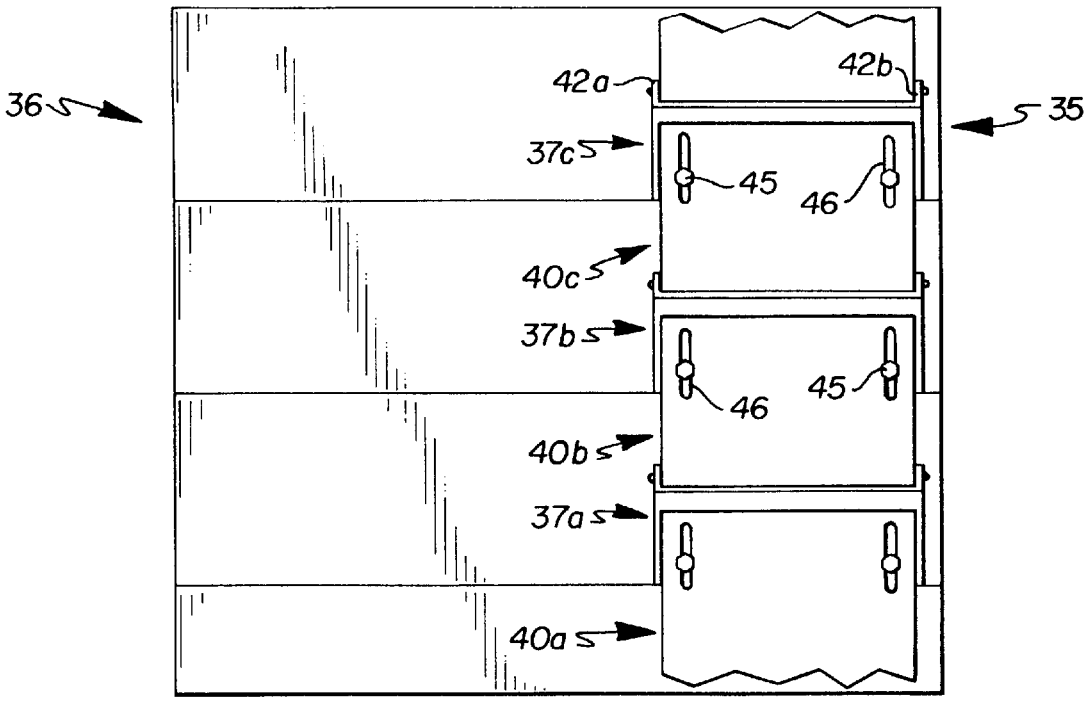
FIG. 7 is a front view of a portion of a third embodiment of the assembly.
Figure 8:
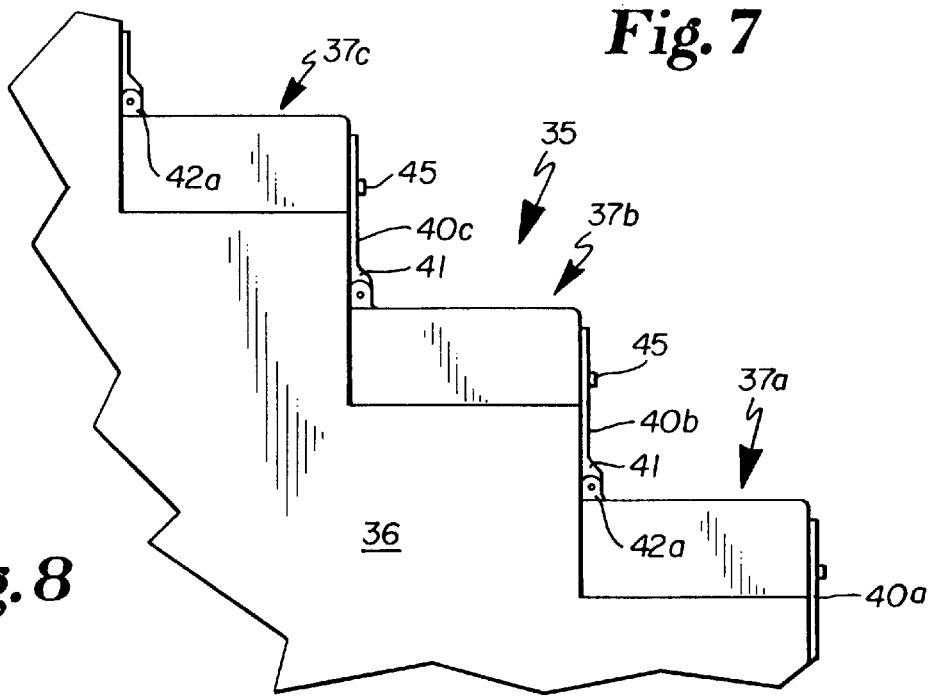
FIG. 8 is a right side view of the assembly shown in FIG. 7.

Referring to FIGS. 7 and 8, third embodiment of the stairway step assembly 35 is shown deployed on stairs 36 of equivalent dimensions to that of stairs 13 discussed above. The assembly 35 comprises a plurality of step members 37*a–c* and a plurality of connection members 40. The step members 37 have a box shaped configuration. The separate, flat, connector 40 is connected to the front face of each step member 37 by bolts or other fasteners 45 through adjustable connection slots 46, and extends downwardly for connection to the lower successive step member 37. The bottom edge 41 of the connection member 40 is thickened and has a laterally disposed, cylindrical channel therein. The upper portion 39 of each step further has a pair of connection extensions 42*a–b* connected to its top surface at the rearward corners thereof for coupling with the next higher step member 37. An elongated bolt extends through one extension 42*a*, the channel in portion 41 and through the other extension 42*b* to connect adjacent step members 37.

Figure 9:
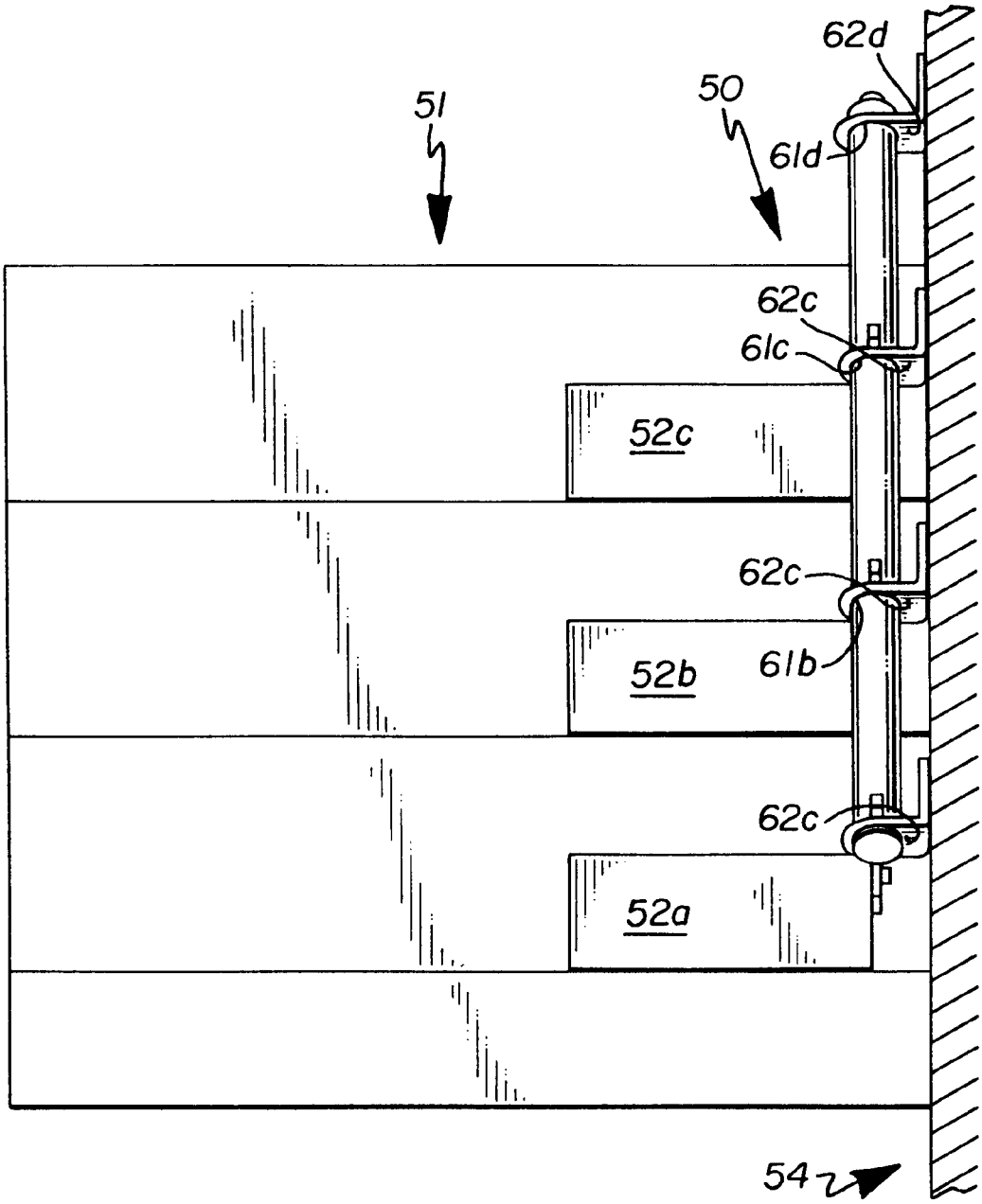
FIG. 9 is front view of a portion of a fourth embodiment of the assembly.
Figure 10:
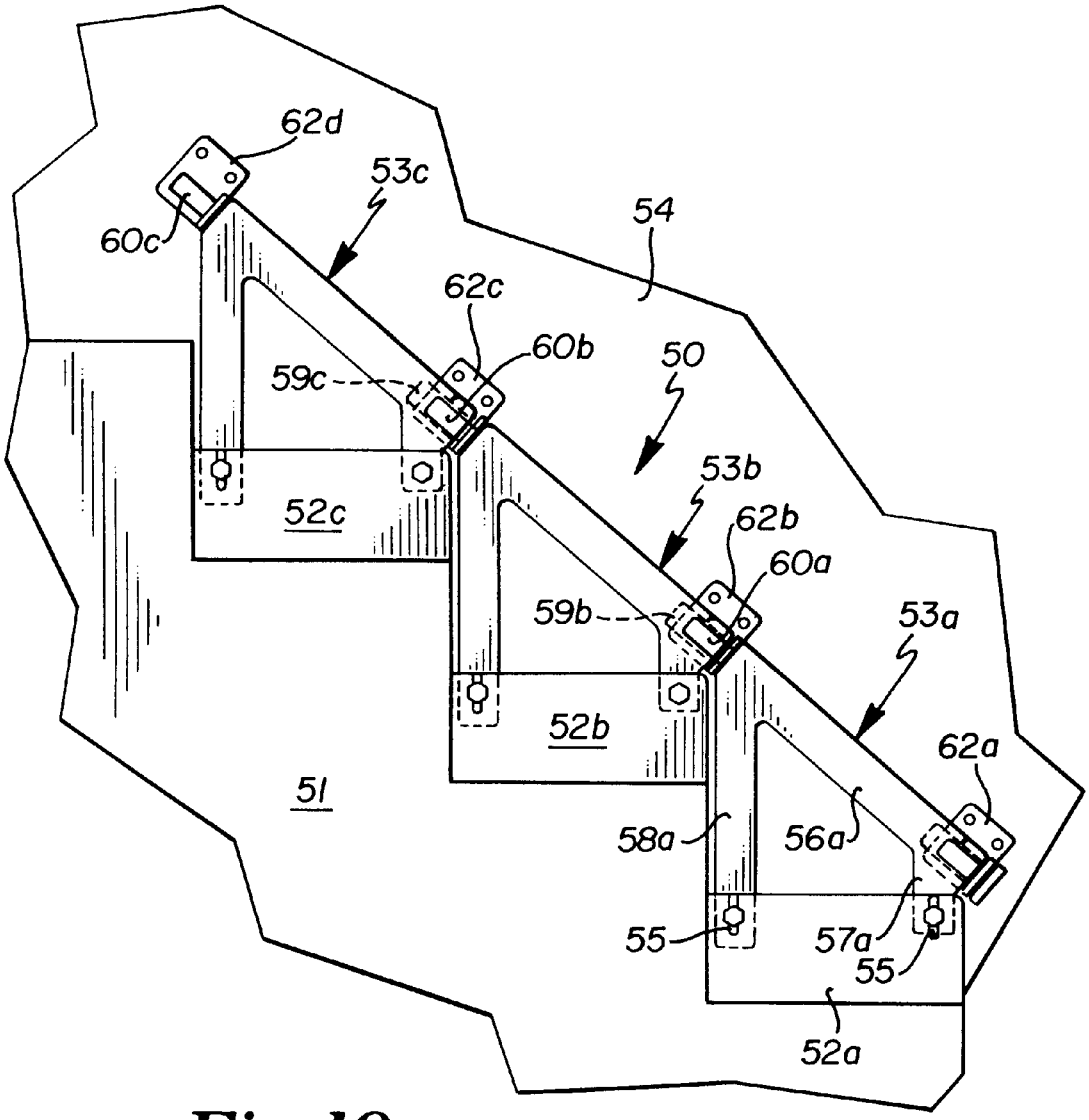
FIG. 10 is a right side view of the assembly shown in FIG. 9.
Figure 11:
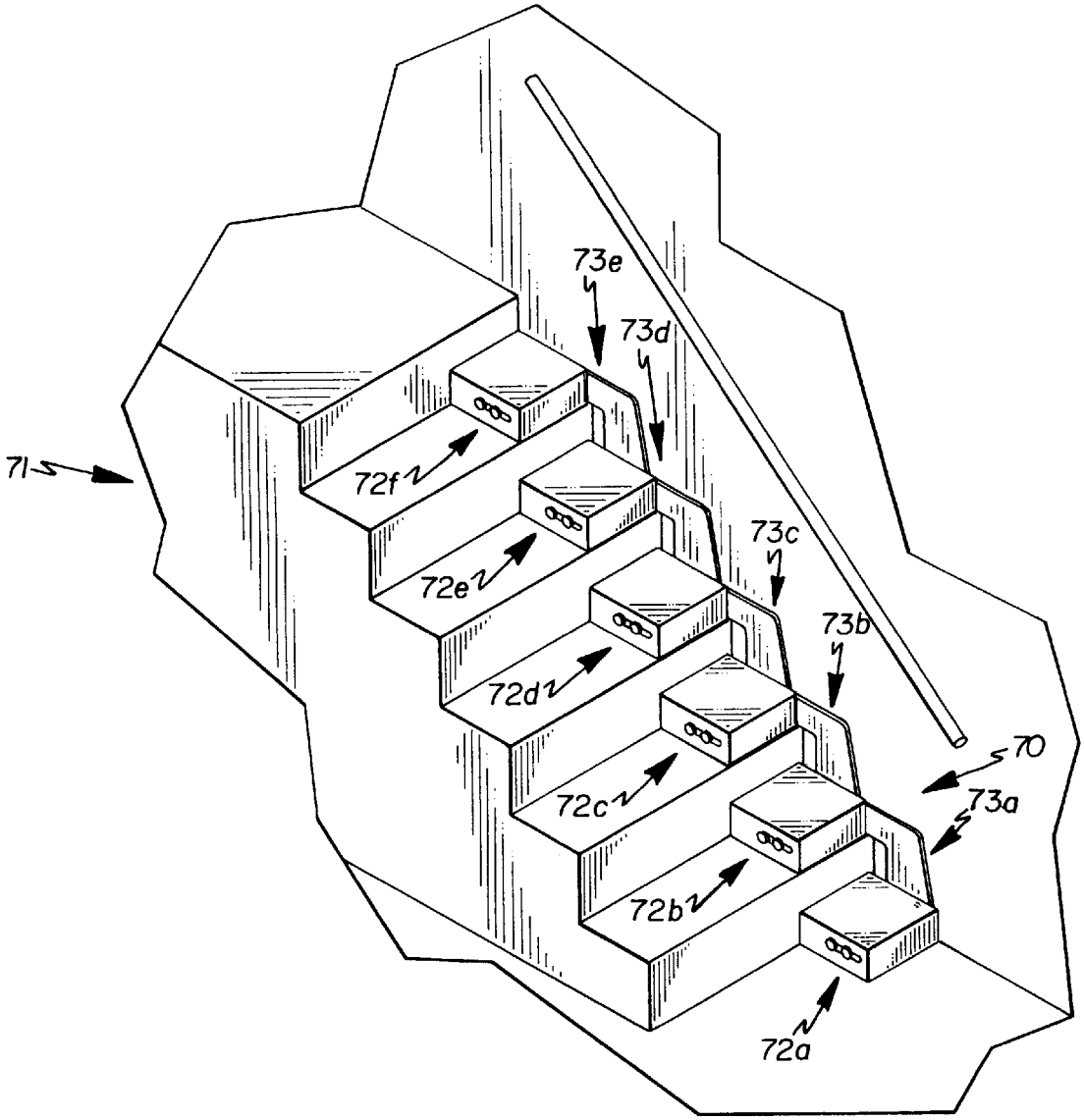
FIG. 11 is a perspective view of a fifth embodiment of the assembly.
Figure 12:
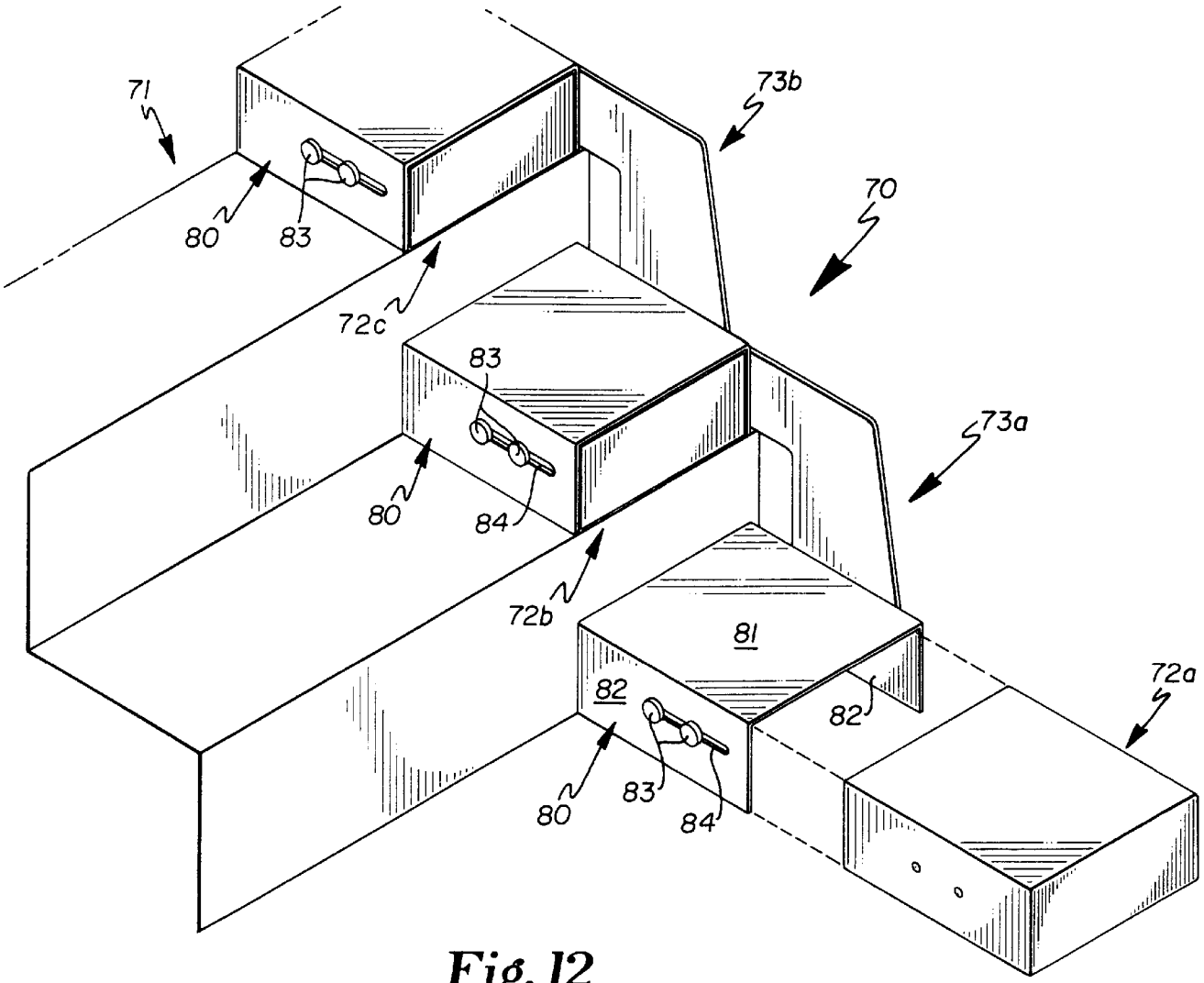
FIG. 12 is a detailed view of a portion of the assembly shown in FIG. 11.
Figure 14:
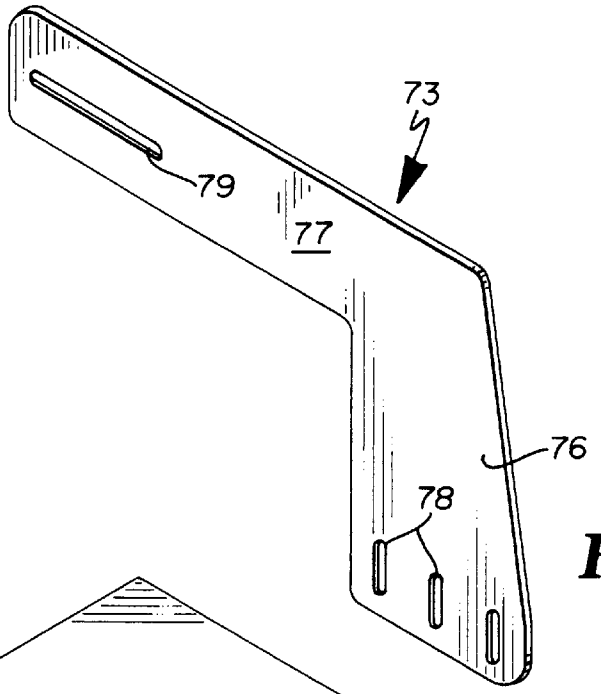
FIG. 14 is a perspective view of one connection member of the assembly.
Figure 13:
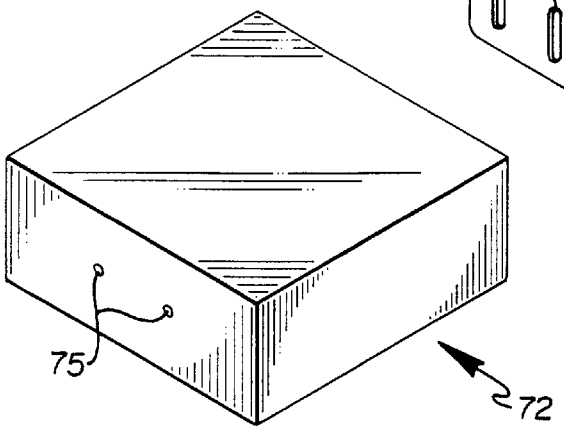
FIG. 13 is a perspective view of one step member of the assembly.
Figure 15:
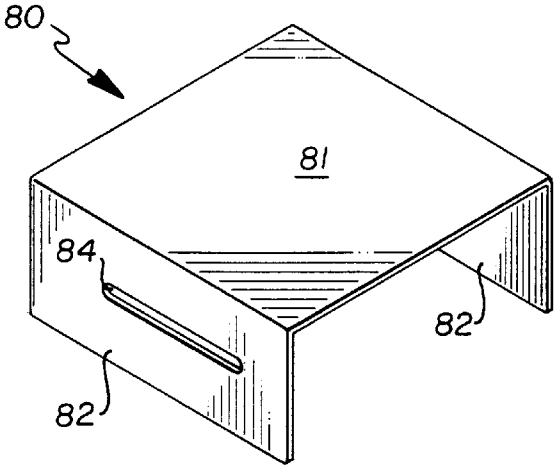
FIG. 15 is a perspective view of one extension member of the assembly.
Figure 19:
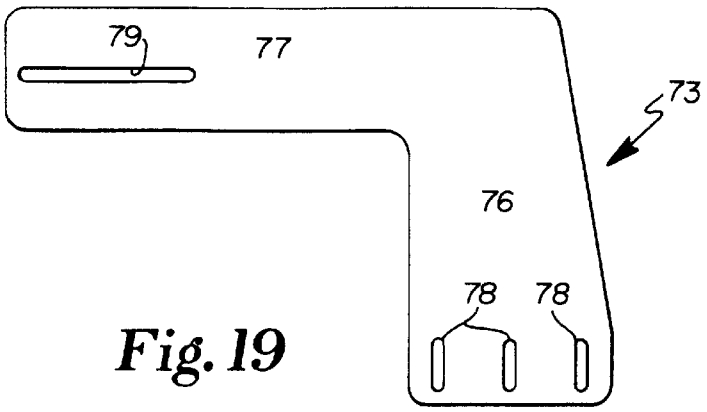
FIG. 19 is a side view of the connection member.

Referring to FIGS. 9 and 10, a fourth embodiment of the stairway step assembly 50 is shown deployed on stairs 51 of equivalent dimensions to that of stairs 13 discussed above. The stairs 51 abuts left side wall 54. The assembly 50 comprises a plurality of step members 52*a–c* and a plurality of connection members 53*a–c* which are interlocked with respect to each other and are further each attached to the wall 54. The step members 52 each have a box-type configuration with a pair of apertures 55 disposed near the upper front and back corner on the right side wall thereof The connection members 53 each has an angled member 56, a short front vertical member 57 and a longer rear vertical member 58. The bottom end of each angled member 56 has a connection aperture 59, while the top end has a connection pin 60 which is inserted in the connection aperture 59 of the next higher member 53. The connection pins 60 further extend through a circular aperture 61 of a wall bracket 62, which is fastened to the wall 54. This structure permits the stairs 52 to be pivoted upwardly away from the stairs 51 and towards the wall 54.

Referring to FIGS. 11–21, a fifth embodiment of the stairway step assembly 70 is shown deployed on stairs 71 of equivalent dimensions to that of stairs 13 discussed above. The assembly 70 comprises a plurality of step members 72*a–f*, a plurality of connection members 73*a–e*, and preferably a plurality of extension members 80. The step members 72 of the assembly 70 have a box shaped configuration and are constructed of aluminum. Alternative construction materials include other lightweight, strong metals, plastic, composites, and wood. The right side of each step member 72 has a pair of apertures 74 which are horizontally aligned with respect to each other. The left side of each member 72 also has a pair of horizontally aligned apertures 75.

The connection members or connectors 73 are flat, generally L-shaped plate structures with a vertical member 76 and a horizontal member 77. The connectors 73 have a set of three apertures or slots 78 disposed near the bottom end of the vertical member 76 two of which are aligned with the apertures 74 of the step 72 for connection via a bolt or other fastening means (not shown). The extra or third aperture 78 permits horizontal adjustment of the position of the step 72 with respect to the connector 73. An elongated slot 79 is disposed at the end of the horizontal member 77, aligned horizontally. This slot 79 is used to connect the step 72 to an extension member 80 as is described further below.

The extension members 80 are connected to the steps 72 and enable them to be adjusted (longitudinally) to fit the size, depth-wise (commonly referred to as the "run", of the top horizontal surface of the stairs 71 steps. The extension members 80 are flat, relatively thin, U-channel shaped elements having a top, horizontal plate 81 and a pair of side, vertical plates 82. Each member 80 fits snugly over a step 72 and is connected there to by a bolts or other fastening members 83 disposed through an elongated, horizontally oriented slot 84 in the left side plate 82, which further extend into apertures 75 of step 72. Right side plate also has a slot 85 to accommodate the fasteners used to couple the connector 73 to the step 72. In use, the extension member 80 is slid laterally to fit the full size of the stairs 71 step and the fasteners 83 are tightened. The other embodiments of the step members may be modified to provide run adjustment utilizing this design.

Figure 22:
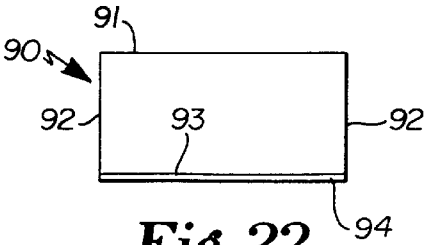
FIG. 22 is a front view of one step member of a sixth embodiment of the assembly.
Figure 20:
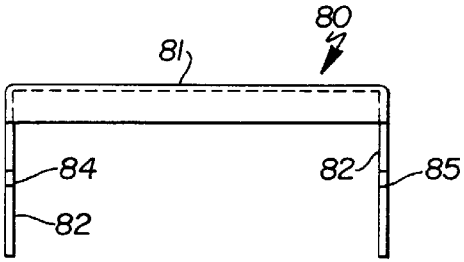
FIG. 20 is a front view of the extension member.
Figure 21:
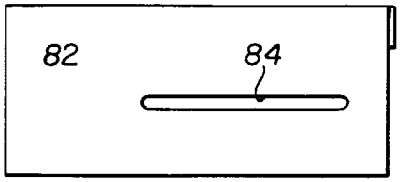
FIG. 21 is a side view of the extension member.
Figure 16:
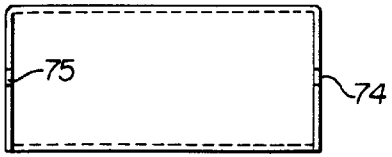
FIG. 16 is a front view of the step member.
Figure 17:
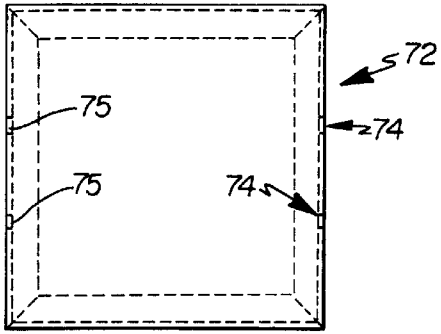
FIG. 17 is a top view of the step member.
Figure 18:
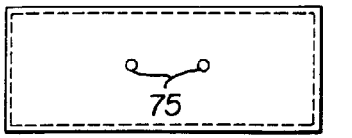
FIG. 18 is a side view of the step member.
Figure 25:
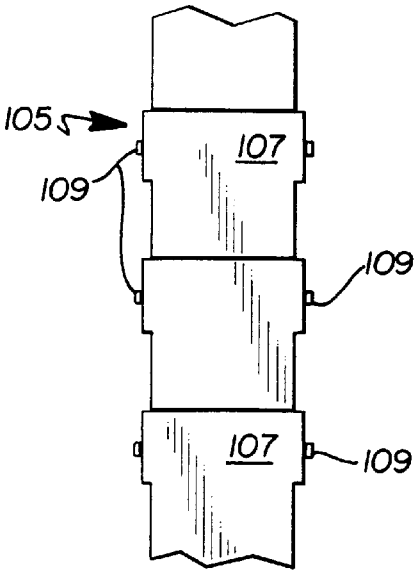
FIG. 25 is a front view of the assembly.
Figure 29:
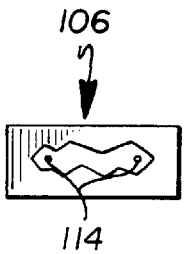
FIG. 29 is a front view of the lower unit.
Figure 28:
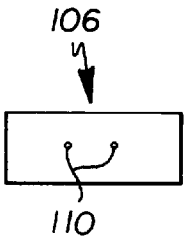
FIG. 28 is a side view of a lower unit of the assembly.
Figure 24:
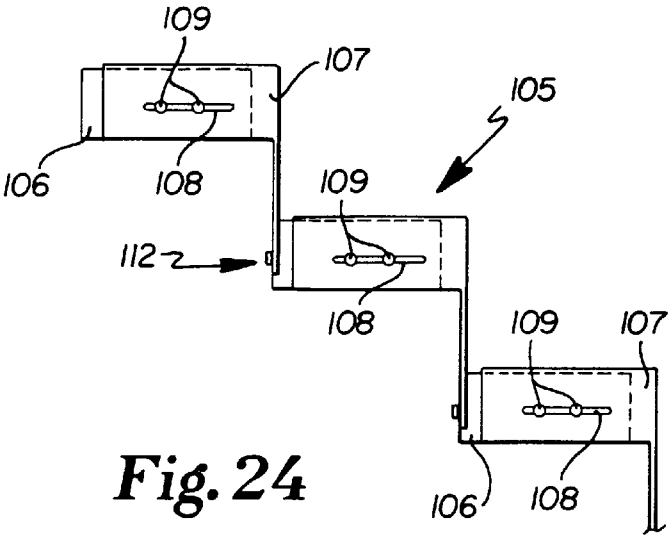
FIG. 24 is a side view of an eighth embodiment of the assembly.
Figure 27:
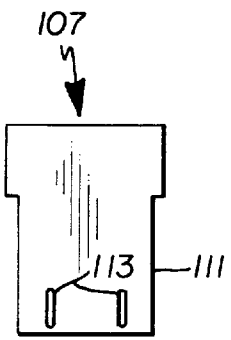
FIG. 27 is a front view of the upper unit.
Figure 26:
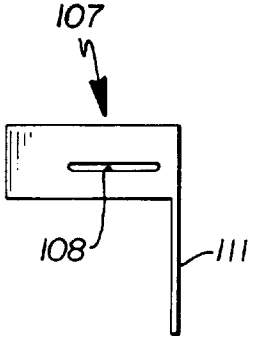
FIG. 26 is a side view of an upper unit of the assembly.
Figure 33:
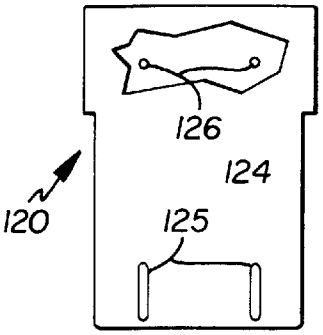
FIG. 33 is a front view of the lower unit.
Figure 32:
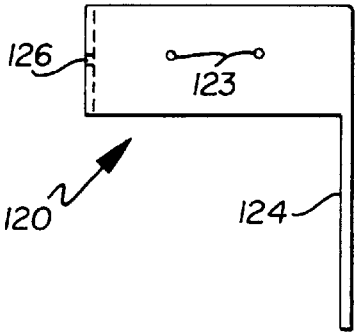
FIG. 32 is a side view of a lower unit of the assembly.
Figure 31:
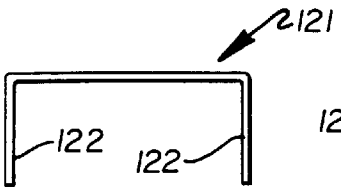
FIG. 31 is a front view of the upper unit.
Figure 30:
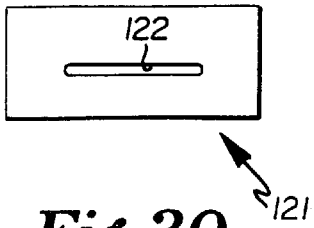
FIG. 30 is a side view of an upper unit of a ninth embodiment of the assembly.
Figure 43:
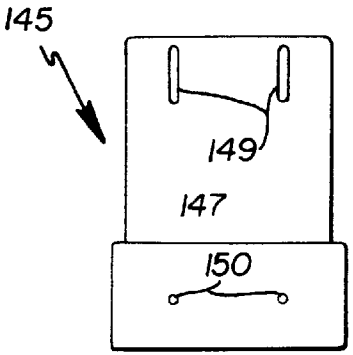
FIG. 43 is a front view of the lower unit.
Figure 42:
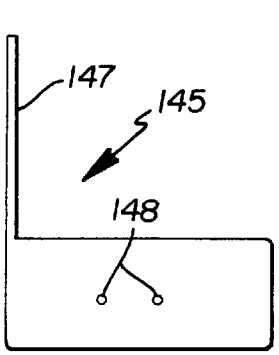
FIG. 42 is a side view of a lower unit of the assembly.
Figure 41:
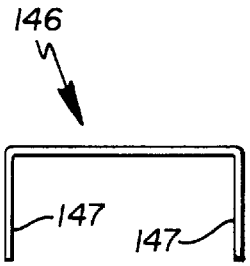
FIG. 41 is a front view of the upper unit.
Figure 40:
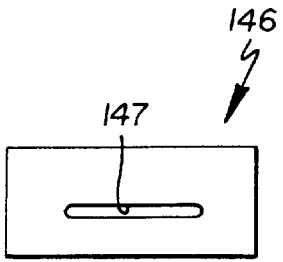
FIG. 40 is a side view of an upper unit of an eleventh embodiment of the assembly.
Figure 34:
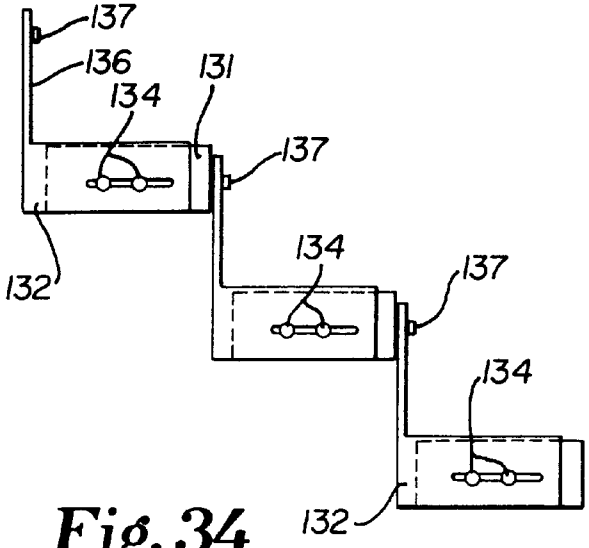
FIG. 34 is a side view of a tenth embodiment of the assembly.
Figure 35:
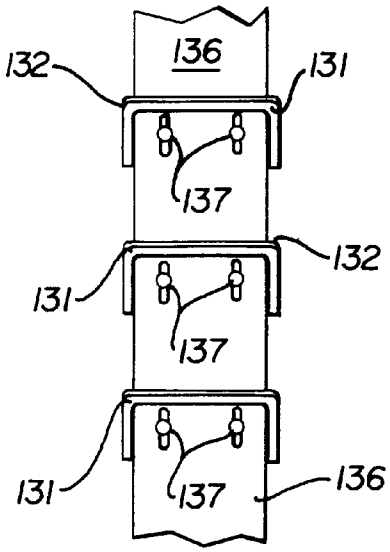
FIG. 35 is a front view of the assembly.
Figure 36:
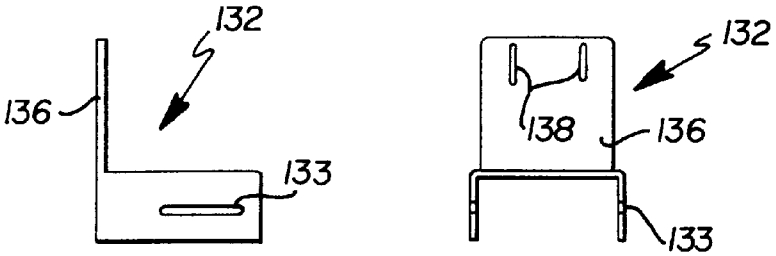
FIG. 36 is a side view of an upper unit of the assembly.
Figure 37:
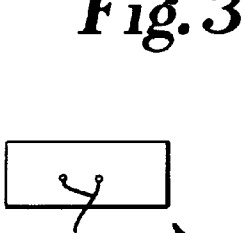
FIG. 37 is a front view of the upper unit.
Figure 38:
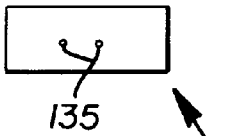
FIG. 38 is a side view of a lower unit of the assembly.
Figure 39:
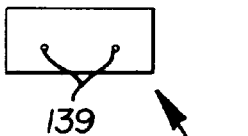
FIG. 39 is a front view of the lower unit.

Referring to FIG. 22, a sixth embodiment of the present invention wherein at least one individual step 90 having a box-like configuration with a top member 91, at least two side members 92 and a bottom member 93. The step 90 is attached to the top surface of a stairs step by a hook and loop style connector, for example VELCRO. As shown, a layer 94 of hook-type material of a predetermined size, is attached to the bottom member 93 of the step 90. When place on a carpeted stairs surface, the layer 94 couples with the carpet fibers to secure the step 90 in place. When placement on a smooth, not carpeted stairs surface, such as wood, vinyl, tile or the like, is desired the a layer of loop-style material (not shown) is attached to the stair step, in alignment with the layer 94 of hook-style material.

Figure 23:
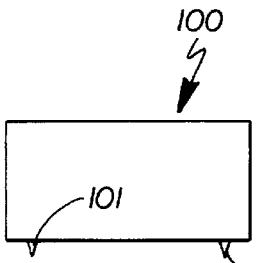
FIG. 23 is a front view of one step member of a seventh embodiment of the assembly of the present invention.

Referring to FIG. 23, a seventh embodiment comprises at least one step 100 which is substantially similar to the step 90 described above except that it has a plurality of prong members 101 for gripping carpeted or other surfaces on a stairs step.

FIGS. 24–29 show an eight embodiment of the assembly 105. The assembly includes a box-like lower or base member 106 and a channeled upper member 107 which is slidably disposed over the lower member 106 for step run adjustment. The upper member 107 has horizontal slots 108 which receive connectors 109 extending through apertures 110 in the bottom member 106. The upper member 107 further has a front plate 111 which extends downwardly for connection to the next lower bottom member, and providing step rise adjustability, via connectors 112 disposed in apertures 113 and 114. The bottom end of the front plate 111 is shown abutting the back surface of the base member 106, but it may alternatively be connected in a vertically oriented slot (not shown) disposed in the back end of the base member 106.

FIGS. 30–33 show members of a ninth embodiment of the assembly which includes a box-like lower member 120 and a channeled upper member 121. The upper member 121 has horizontal slots 122 which receive connectors (not shown) which extend through apertures 123 in the bottom member 120. The bottom member 120 further has a front plate 124 which extends downwardly for connection to the next lower bottom member for step rise adjustment, via connectors (not shown) disposed in apertures 125 and 126.

FIGS. 34–39 show a tenth embodiment of the assembly 130. The assembly includes a box-like lower or base member 131 and a channeled upper member 132 which is slidably disposed over the lower member 131 for step run adjustment. The upper member 132 has horizontal slots 133 which receive connectors 134 extending through apertures 135 in the bottom member 131. The upper member 132 further has a back wall 136 which extends upwardly or connection to the next higher bottom member, and providing step rise adjustability, via connectors 137 disposed in apertures 138 and 139.

FIGS. 40–43 show members of an eleventh embodiment of the assembly which includes a box-like lower member 145 and a channeled upper member 146. The upper member 146 has horizontal slots 151 which receive connectors (not shown) which extend through apertures 148 in the bottom member 145. The bottom member 145 further has a back wall 147 which extends upwardly for connection to the next higher bottom member for step rise adjustment, via connectors (not shown) disposed in apertures 149 and 150.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

The invention claimed is:

1. A step assembly, comprising:

(a) a plurality of step members, said step members having predetermined horizontal dimensions and a predetermined height which is approximately one-half the height of a step of a stairs, each said step member having a box shaped configuration with a horizontal top surface and a pair of vertical side surfaces, and each said step member further having at least one aperture on a first end of one said side surface and at least one aperture on a second end of said one side surface; and (b) a connector for connecting each said step member in a fixed position on a top, horizontal section of a stairs step, said connector including a flat, elongated, rectangular plate having at least one aperture at one end and at least one aperture an opposite end, said connector further including a fastener disposed through each said aperture and through an aligned aperture on said step member.

2. A step assembly, comprising:

(a) a plurality of step members, said step members having predetermined horizontal dimensions and a predetermined height which is approximately one-half the height of a step of a standard stairs, wherein each said step member has a box shaped configuration with a horizontal top surface and a pair of vertical side surfaces and wherein each said step member has a pair of extension members disposed on said top surface, and a plate-like, frontal lower portion having a lateral channel at a bottom end thereof; and (b) a connector for connecting each said step member in a fixed position on a top, horizontal section of a standard stairs step.

3. A step assembly, comprising:

(a) a plurality of step members, said step members having predetermined horizontal dimensions and a predetermined height which is approximately one-half the height of a step of a standard stairs, wherein each said step member has a box shaped configuration with a horizontal top surface and a pair of vertical side surfaces, and wherein each said step member has a pair of adjustment apertures at predetermined positions and a pair of extension members disposed on said top surface; and (b) a connector for connecting each said step member in a fixed position on a top, horizontal section of a standard stairs step.

4. A step assembly, comprising:

(a) a plurality of step members, said step members having predetermined horizontal dimensions and a predetermined height which is approximately one-half the height of a step of a standard stairs, wherein each said step member comprises a lower member having a box-like configuration and a pair of side walls and an upper member having a U-channel configuration with a pair of side walls, a front wall and a back wall, said upper member being slidably disposed over said lower member; and (b) a connector for connecting each said step member in a fixed position on a top, horizontal section of a standard stairs step.

* * * * *